United States Patent [19]

Gamlin

[11] 4,158,519

[45] Jun. 19, 1979

[54] ROCK REINFORCEMENT

[75] Inventor: Douglas W. Gamlin, Ayr, Scotland

[73] Assignee: Imperial Chemical Industries Limited, London, England

[21] Appl. No.: 817,675

[22] Filed: Jul. 21, 1977

[30] Foreign Application Priority Data

Aug. 6, 1976 [GB] United Kingdom ..... 32842/76

[51] Int. Cl.[2] ..... E21D 21/00

[52] U.S. Cl. ..... 405/260; 405/259

[58] Field of Search ..... 61/45 B, 63; 52/698; 85/63; 175/65; 166/65, 77

[56] References Cited

U.S. PATENT DOCUMENTS

| | | | |
|---|---|---|---|
| 2,810,442 | 10/1957 | Tausch | 166/77 X |
| 2,946,565 | 7/1960 | Williams | 175/65 X |
| 3,022,822 | 2/1962 | Mastravick et al. | 166/77 X |
| 3,216,306 | 11/1965 | Taylor | 61/45 B X |
| 3,226,933 | 1/1966 | White | 61/45 B X |
| 3,285,629 | 11/1966 | Cullen et al. | 166/65 UX |
| 3,312,282 | 4/1967 | Yetman | 166/77 X |
| 3,332,244 | 7/1967 | McLean | 61/45 B X |
| 3,727,693 | 4/1973 | Tausch et al. | 166/77 X |
| 3,756,388 | 9/1973 | Murphy | 61/45 B X |
| 3,861,155 | 1/1975 | Steinberg et al. | 61/45 B |
| 3,971,226 | 7/1976 | Morrell | 61/45 B |

FOREIGN PATENT DOCUMENTS

| | | | |
|---|---|---|---|
| 1104471 | 4/1961 | Fed. Rep. of Germany | 61/45 B |
| 2228852 | 1/1974 | Fed. Rep. of Germany | 61/45 B |

*Primary Examiner*—Dennis L. Taylor

*Attorney, Agent, or Firm*—Cushman, Darby & Cushman

[57] ABSTRACT

A method of rock reinforcement comprising drilling a hole into the rock mass, inserting a length of flexible rope lengthwise into the drillhole and injecting a fluent hardenable grouting material into the space between the rope and the drillhole wall. In the preferred method the rope is inserted by attaching one end to a piston element and injecting the grouting material against the piston element.

11 Claims, 3 Drawing Figures

ROCK REINFORCEMENT

This invention relates to rock reinforcement by the method wherein holes are drilled into the rock and filled with a hardening grouting composition.

The method of rock reinforcement finds widespread application for rock strata reinforcement in coal mining and is also being increasingly used in other mining and civil engineering operations.

As generally applied, holes are drilled into the coal or other strata, long hardwood dowels are pushed into the holes and resin or other hardening grout is placed around the dowels by pumping or by prior insertion of grouting materials in frangible capsules which are broken by rotation of the dowel in the drillhole. On hardening the grout bonds the dowel to the wall of the drillhole and flows into the fissures and cracks within the rock. The dowel strengthens the composite structure and also acts as a filler within the bonding medium. Thus with the holes filled transversely to the rock strata several weak strata can be knitted together to form a strong composite beam.

Wooden dowels are advantageous in this method as they can be readily cut by the machines normally used to cut the reinforced strata without causing any damage to the cutting machines. In holes longer than 6 feet, more than one dowel is normally used and there will then normally be gaps between adjacent dowel ends thereby giving non-uniform reinforcement along the drillhole and relatively weak zones in the reinforced strata. Also the long wooden dowels are inconvenient to transport and handle in mines.

It is an object of this invention to replace the wooden dowels normally used in strata reinforcement by reinforcing material which will give uniform reinforcement and be more convenient to handle.

In accordance with this invention a method of rock reinforcement comprises drilling a hole into a rock mass, inserting a length of flexible rope lengthwise into the drillhole to leave a space between the rope surface and the drillhole wall and injecting a fluent, hardenable grouting material into the said space whereby, when the grouting material hardens, the rope is bonded to the said drillhole wall and the rock mass is consequently reinforced.

The rope may advantageously be supplied from a coil. When the required length of rope has been inserted into a drillhole the rope may be cut and a new length inserted into a further hole.

Conveniently the grouting material and the rope are both fed into the drillhole through the same nozzle, said nozzle being provided with separate inlet ducts for the grouting material and the rope respectively.

In a preferred method the rope is inserted into the drillhole by attaching an end of the rope to a piston element which is slidable in the drillhole, inserting said piston element into the drillhole and injecting the grouting material against the end of said piston element whereby the piston element is driven towards the blind end of the drillhole and the rope is drawn into the drillhole and surrounded with the fluent, hardenable grouting material. Air initially in the drillhole is displaced into the rock fissures. Preferably the leading end of the rope to be inserted into the drillhole is trained through an inlet duct of a nozzle and through the nozzle, a piston element is attached to the rope end, the piston element and the nozzle are inserted into the drillhole and fluent grouting material is injected through a second inlet duct and the nozzle into the drillhole to drive the piston element towards the blind end of the drillhole.

The piston element may be made of any convenient material but a non-metallic material is preferred. Wood or synthetic plastics materials such as, for example, polyethylene, polypropylene or polyvinyl chloride are especially suitable since these materials may be readily formed to any suitable shape. The piston element should have an appropriate outside diameter to provide adequate sealing of the drillhole and yet be movable along the drillhole. The effective length of the piston element should be sufficient to ensure that the element is maintained in substantial axial alignment with the drillhole. Preferably the piston element should have a length at least equal to its diameter. The piston element may be of uniform circular cross section along its length but if desired it may be recessed or formed as a solid or hollow element. Where the annular space between the rope and the drillhole wall is relatively small a solid annular construction may be convenient but for larger clearances the preferred piston element comprises a body portion having at least one annular flexible sealing disc fixed thereon.

The rope may be connected to the piston element by any convenient connecting means but conveniently it is secured in a socket formed in the piston element. The socket may conveniently be provided with rope retaining means, for example, internal projections such as spikes, ribs or a screw thread adapted to grip the rope end when the rope is forced into the socket. Alternatively the rope may be fixed in the socket with one or more wedging elements. Advantageously the socket is a bore extending through the length of the piston element in which bore the rope is wedged by a tapered spike driven axially into the leading end of the rope when the rope is positioned in the socket. The connection is improved by flaring the bore towards the end where the spike is inserted. The spike may also carry one or more additional annular sealing discs adapted to engage the drillhole wall and serve as an additional sealing stage (or stages) for the piston element. A further kind of secure attachment of the rope can be obtained by means of a resilient compression ring compressed between a cylindrical surface of the socket and the rope end.

The rope may be made of any convenient flexible material such as natural fibre, for example cotton, jute or hemp, or from synthetic fibre, for example nylon, polyethylene-terephthalate or polypropylene, or metal filament, for example steel wire. The rope may be constructed in any convenient manner. One convenient construction of rope is that known as linear composite construction consisting of a core of parallel filaments of synthetic plastics, for example polyethylene-terephthalate, encased in a synthetic plastics sheath, for example polyethylene. A suitable rope of this construction is commercially available under the name Parafil (Registered Trade Mark). The hardening grout may comprise any convenient pumpable hardening grouting material such as polyester resin, portland cement or gypsum plaster.

The invention also includes a rock mass reinforced by the aforedescribed method.

The invention is further illustrated by the following description of one preferred manner of putting the invention into practice which is hereinafter described by way of Example with reference to the accompanying drawings wherein FIG. 1 shows diagramatically in interrupted longitudinal medial section a length of rope and surrounding grouting material immediately after loading into a drillhole in a rock mass.

Figure 1:
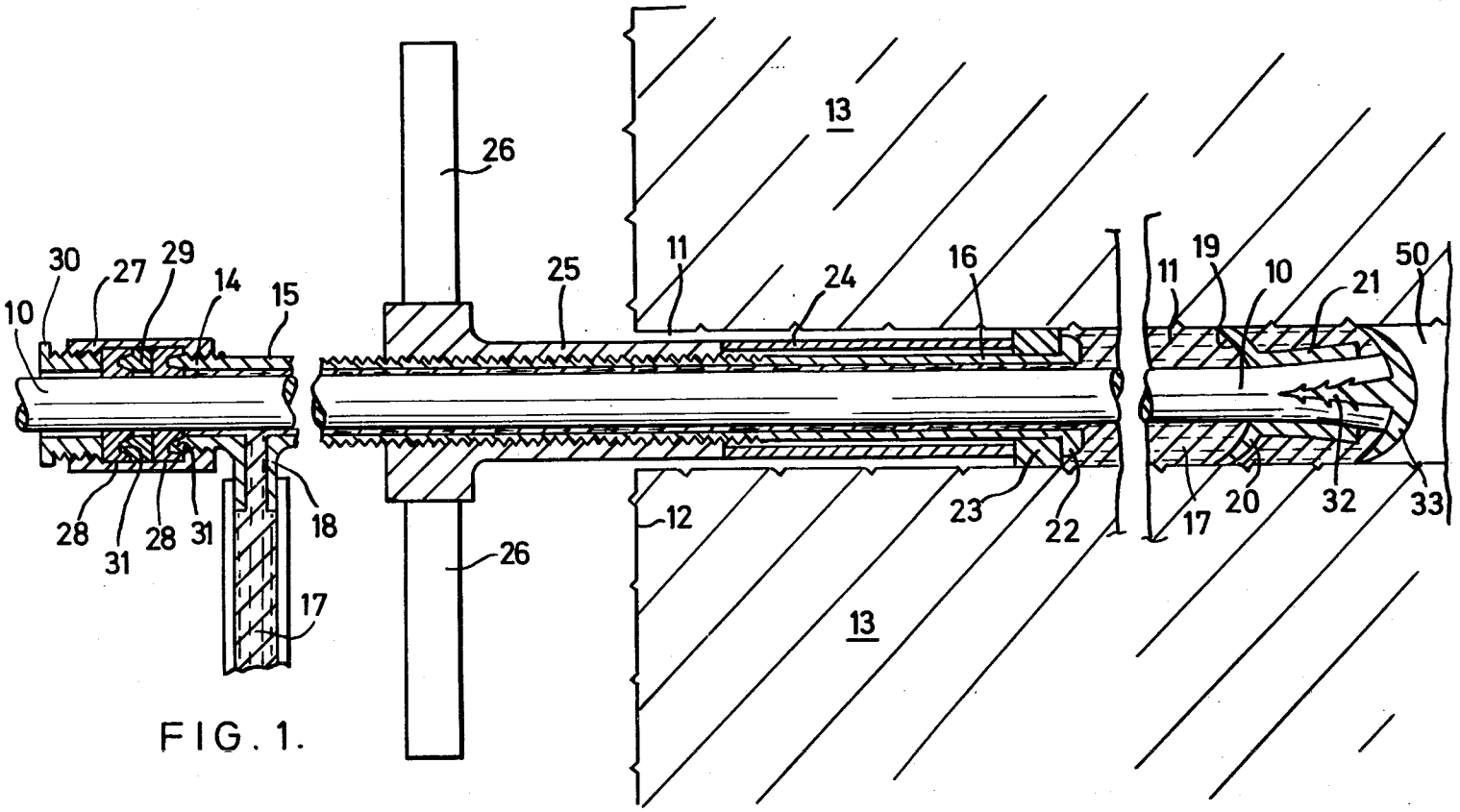

As shown in FIG. 1 a length of rope 10 is located in a drillhole 11 drilled substantially perpendicularly from a free rock face 12 into a stratified rock mass 13. The rope 10 extends through an inlet duct 14 of a nozzle 15, through an outlet end 16 of the nozzle and into the drillhole 11. Hardening grouting material 17 is fed under pressure from a grout injector pump (not shown) through a second inlet duct 18 of the nozzle 15. The grouting material bears on an end face 19 of a resilient disc 20 formed on a piston element 21 which is connected to the end of the rope 10 and forces the rope towards the blind end of the drillhole 50.

The nozzle outlet end 16 is provided with a surrounding abutment collar 22 and a rubber sealing ring 23 which, when compressed axially, seals the annular space between the nozzle outlet end 16 and the drillhole when the nozzle is placed in its operative position with the end 16 in the mouth end of the drillhole 11. A sleeve element 24, sleeved over the nozzle outlet end 16, abuts the sealing ring 23 and a compression element 25 is threaded over a threaded portion of the end 16 to abut the element 24, whereby, when the element 25 is screwed along the outlet end 16 towards the collar 22, the sealing ring 23 is compressed into sealing engagement with the drillhole 11. Arms 26 are fixed to the element 25 to facilitate rotation of the element 25.

A tubular housing 27 coaxially screwed on the end of the inlet duct 14 accommodates two rubber sealing rings 28 which are separated by a rigid spacer ring 29 and compressed against the rope 10 by a tubular compression element 30 screwed into the housing 27. The sealing rings 28 which seal the annular space between the rope 10 and the duct 14 are formed with annular grooves 31 which are expanded by the pressure of the grouting material to press the inner edges of the rings more firmly against the rope 10 as the pressure increases. Chevron shaped compression sealing rings could also conveniently be used.

The piston element 21 is formed with a tapered axial bore having its largest diameter at the innermost end in the drillhole. It is sleeved on the end of the rope 10 and fixed thereon by a spike element 32 driven axially into the rope end to expand the rope end into engagement with the tapered surface of the bore. Integrally formed with the spike element 32 is a sealing disc 33 which acts as a second stage seal and piston surface to stop any grouting material which may pass the sealing disc 20 from travelling to the end of the drillhole in advance of the rope 10.

Figure 2:
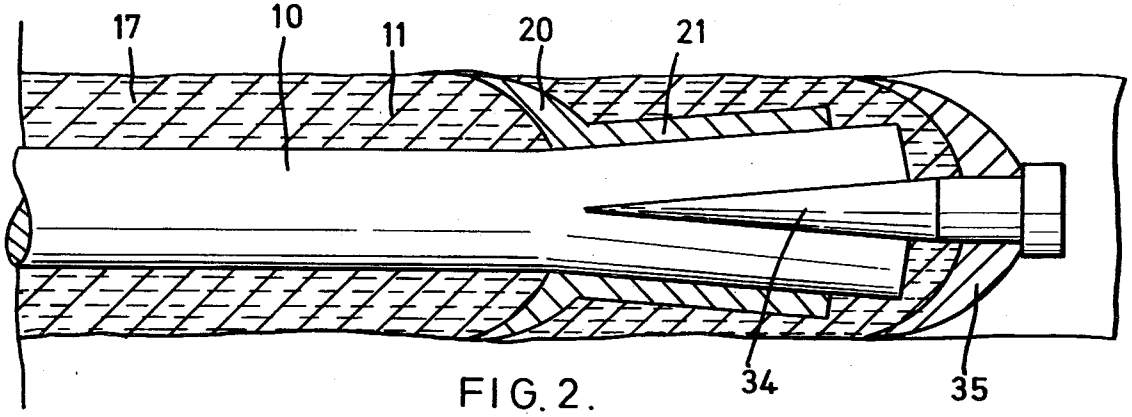
FIG. 2 shows diagramatically in longitudinal medial section a modified form of the means for connecting the piston element to the rope.

In the modified form of piston connecting means shown in FIG. 2 the spike is a metal spike 34 which carries a separate resilient second stage sealing disc 35.

Figure 3:
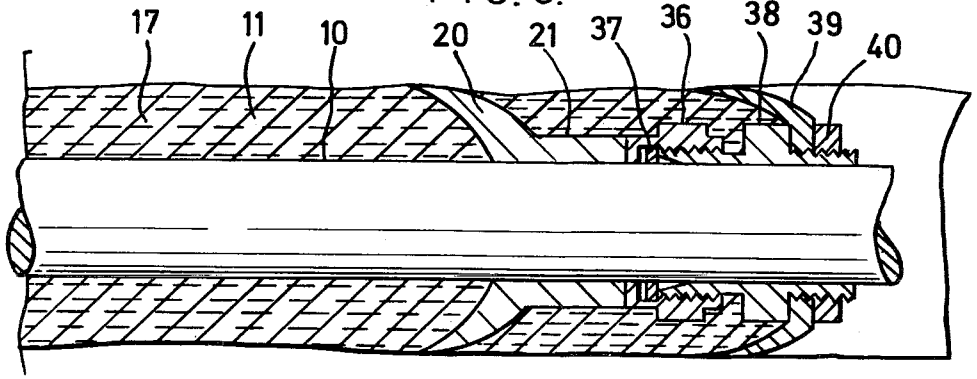
FIG. 3 shows diagramatically in longitudinal medial section a further means of retaining the piston element on the rope end.

In the piston retaining means shown in FIG. 3 the piston element 21 abuts a housing 36 which is sleeved over the rope end 10. The housing contains a rubber compression sealing ring 37 which is compressed in the housing by a compression element 38 sleeved over the rope end and screwed into an internal thread of the housing 36. A second stage sealing disc 39 is fixed on the element 38 by a retaining nut 40.

A rock mass may be reinforced by rope lengths and grout in the manner shown in FIG. 1 by first drilling holes 11 into the rock mass in a direction transverse to the strata. A length of rope 10 from a coil supply (not shown) is trained through the inlet duct 14 and the nozzle outlet 16 of a nozzle 15, which is conveniently a hand held nozzle attached to the delivery pipe of a pump (which may also be a hand held injector gun) delivering grouting material. An element 21 is fixed onto the rope end as described above, and then inserted into the mouth end of the drillhole 11. The nozzle end 16 is then placed in the mouth end of the drillhole 11 and the sealing ring 23 is tightly compressed against the drillhole surface by rotation of the compression element 25. Soft fluent grouting material 17 is pumped into the inlet duct 14, through the nozzle outlet end 16 into the drillhole 11 against the face 19 of the piston element 21. The piston element 21 is thereby forced to the blind end of the drillhole 11 drawing the rope 10 through the nozzle 15 into the drillhole 11. The annular space around the rope in the drillhole becomes filled with grouting material which subsequently sets hard.

When the drillhole is filled with rope and grouting material in the aforedescribed manner the nozzle 15 is removed from the drillhole 11 and the rope is cut at the rock face 12. A further piston element 21 is attached to the newly cut end of the next drillhole to be filled. When all the drillholes have been filled and the grouting material has hardened the rock mass is markedly strengthened. By means of this method drillholes of 30 feet or more may be filled with reinforcing materials.

What we claim is:

1. A method of rock reinforcement comprising drilling a hole into a rock mass, attaching an end of a rope to a piston which has a resilient circumferential portion in slidable sealing engagement with the drillhole wall, inserting the piston into the drillhole and injecting a fluent, hardenable grouting material against the outer end of the piston and into a space between the rope surface and the drillhole wall to drive the piston toward the blind end of the drillhole, to draw the rope into the drillhole and to surround the rope with the grouting material whereby, when the grouting material hardens, the rope is bonded to the drillhole wall and the rock mass is consequently reinforced.

2. A method as claim 1 wherein the grouting material and the rope are both fed into the drillhole through a single nozzle, said nozzle being provided with separate inlet ducts for the grouting material and rope respectively.

3. A method as claimed in claim 1 wherein the leading end of the rope to be inserted into the drillhole is trained through an inlet duct of a nozzle and through the nozzle whereafter the end of the rope is attached to the piston and wherein the fluent grouting material is injected through a second inlet duct and the nozzle into the drillhole to drive the piston element towards the blind end of the drillhole.

4. A method as claimed in claim 1 wherein the piston is made of wood or synthetic plastics material.

5. A method as claimed in claim 1 wherein the piston has an effective length sufficient to ensure that the piston is maintained in substantial axial alignment with the drillhole.

6. A method as claimed in claim 1 wherein the piston comprises a body portion having at least one annular flexible sealing disc fixed thereon.

7. A method as claimed in claim 1 wherein the rope is secured is a socket formed in the piston.

8. A method as claimed in claim 7 wherein the socket is a bore extending through the length of the piston, in which bore the rope is wedged by a tapered spike driven axially into the leading end of the rope when the rope is positioned in the socket.

9. A method as claimed in claim 8 wherein the spike carries one or more additional annular sealing discs adapted to engage the drillhole wall and serve as an additional sealing stage or stages for the piston element.

10. A method as claimed in claim 7 wherein the rope is secured to the piston by means of a resilient compression ring compressed between the cylindrical surface of the socket and the rope end.

11. A method as claimed in claim 1 wherein the rope comprises a core of parallel filaments of synthetic plastics encased in a synthetic plastics sheath.

* * * * *